US005673640A

United States Patent [19]

Duvall

[11] Patent Number: 5,673,640

[45] Date of Patent: Oct. 7, 1997

[54] MOHAIR QUILTED GARMENT INSERT AND METHOD OF FABRICATION

[76] Inventor: Jaymie L. Duvall, 311 Brink Street 24th P.O. Box 757, Ashcroft, B.C., Canada, V0K-1A0

[21] Appl. No.: 604,770

[22] Filed: Feb. 22, 1996

[51] Int. Cl.[6] ..... D05B 97/00

[52] U.S. Cl. ..... 112/475.09; 2/97; 112/420

[58] Field of Search ..... 112/475.08, 475.09, 112/420, 440, 117; 2/97, 272, 164

[56] References Cited

U.S. PATENT DOCUMENTS

| | | | |
|---|---|---|---|
| 3,541,620 | 11/1970 | Chapuis | 2/272 X |
| 4,214,319 | 7/1980 | Bollag | 2/97 X |
| 4,502,153 | 3/1985 | Lapedes | 2/97 X |
| 5,408,700 | 4/1995 | Reuben et al. | 2/97 |
| 5,539,928 | 7/1996 | Aldridge | 2/97 X |

*Primary Examiner*—Peter Nerbun

[57] ABSTRACT

A mohair quilted garment insert and method of fabrication are disclosed comprising the steps of providing a quantity of raw mohair, washing the raw mohair, drying the washed mohair, picking the dried mohair to remove loose fibers, adding an oil to the picked mohair, providing raw wool, washing the raw wool, drying the washed wool, blending the oiled mohair and dried wool to form a bat, providing an outer layer of moisture resistant fabric and providing an inner layer of flexible fabrics and positioning the blended wool and mohair between the outer and inner layers to form a bat between the inner and outer layers to form a precut garment pattern, stitching the precut pattern with a quilting machine to form rectangular pockets to thereby form an insulating material, and utilizing the insulating material for a wide variety of garments as a liner.

5 Claims, 2 Drawing Sheets

MOHAIR QUILTED GARMENT INSERT AND METHOD OF FABRICATION

BACKGROUND OF THE INVENTION

Field of the Invention

The present invention relates to a mohair quilted garment insert and method of fabrication and more particularly pertains to providing an insert having greater durability characteristics with a mohair quilted garment insert and method of fabrication.

Description of the Prior Art

The use of garment liners is known in the prior art. More specifically, garment liners heretofore devised and utilized for the purpose of lining an interior of a garment are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,217,780to Wurzer discloses a woven ticking, and fabric structure made thereof.

U.S. Pat. No. 3,635,259 to Layton discloses an imitation mohair fabric.

U.S. Pat. No. 5,218,720 to Tolton discloses an inner liner for garment suitable for athletic activities.

U.S. Pat. No. 4,715,068 to Jacobson discloses a garment and liner combination.

U.S. Pat. No. 4,502,153 to Lapedes et al. discloses an apparel liner.

U.S. Pat. No. 4,032,989 to Jay et al. discloses a garment liner.

While these devices fulfill their respective, particular objective and requirements, the aforementioned patents do not describe a mohair quilted garment insert and method of fabrication for providing an insert having greater durability characteristics.

In this respect, the mohair quilted garment insert and method of fabrication according to the present invention substantially departs from the conventional concepts and designs of the prior art, and in doing so provides an apparatus primarily developed for the purpose of providing an insert having greater durability characteristics.

Therefore, it can be appreciated that there exists a continuing need for new and improved mohair quilted garment insert and method of fabrication which can be used for providing an insert having greater durability characteristics. In this regard, the present invention substantially fulfills this need.

SUMMARY OF THE INVENTION

In the view of the foregoing disadvantages inherent in the known types of garment liners now present in the prior art, the present invention provides an improved mohair quilted garment insert and method of fabrication. As such, the general purpose of the present invention, which will be described subsequently in greater detail, is to provide a new and improved mohair quilted garment insert and method of fabrication and method which has all the advantages of the prior art and none of the disadvantages.

To attain this, the present invention essentially comprises a method of fabricating a quilted garment insert comprising the steps of providing a quantity of raw mohair, washing the raw mohair, drying the washed mohair, picking the dried mohair to remove loose fibers, adding a spinrite oil to the picked mohair, providing raw wool, washing the raw wool, drying the washed wool, blending the oiled mohair and dried wool to form a bat having about eighty parts by weight of mohair and twenty parts by weight wool. Additionally, an outer layer of moisture resistant fabric is provided selected from a class of moisture resistant fabrics including 200 Dermoflex or Goretex and an inner layer of flexible fabrics is provided selected from a class of flexible fabrics including polyester and silk. The blended wool and mohair is positioned between the outer and inner layers to form a bat between the inner and outer layers to form a precut garment pattern. The next step is stitching the precut pattern with a quilting machine to form rectangular pockets to thereby form an insulating material. The insulating material is then utilized for a wide variety of garments as a liner.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mohair quilted garment insert and method of fabrication which has all the advantages of the prior art garment liners and none of the disadvantages.

It is another object of the present invention to provide a new and improved mohair quilted garment insert and method of fabrication which may be easily and efficiently manufactured and marketed.

It is a further object of the present invention to provide a new and improved mohair quilted garment insert and method of fabrication which is of durable and reliable construction.

An even further object of the present invention is to provide a new and improved mohair quilted garment insert and method of fabrication which is susceptible of a low cost of manufacture with regard to both materials and labor, and which accordingly is then susceptible of low prices of sale to the consuming public, thereby making such a mohair quilted garment insert and method of fabrication economically available to the buying public.

Still yet another object of the present invention is to provide a new and improved mohair quilted garment insert and method of fabrication which provides in the apparatuses and methods of the prior art some of the advantages thereof, while simultaneously overcoming some of the disadvantages normally associated therewith.

Even still another object of the present invention is to provide a new and improved mohair quilted garment insert and method of fabrication for providing an insert having greater durability characteristics.

Lastly, it is an object of the present invention to provide a new and improved mohair quilted garment insert and method of fabrication comprising the steps of providing a quantity of raw mohair, washing the raw mohair, drying the washed mohair, picking the dried mohair to remove loose fibers, adding an oil to the picked mohair, providing raw wool, washing the raw wool, drying the washed wool, blending the oiled mohair and dried wool to form a bat, providing an outer layer of moisture resistant fabric and providing an inner layer of flexible fabrics and positioning the blended wool and mohair between the outer and inner layers to form a bat between the inner and outer layers to form a precut garment pattern, stitching the precut pattern with a quilting machine to form rectangular pockets to thereby form an insulating material, utilizing the insulating material for a wide variety of garments as a liner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
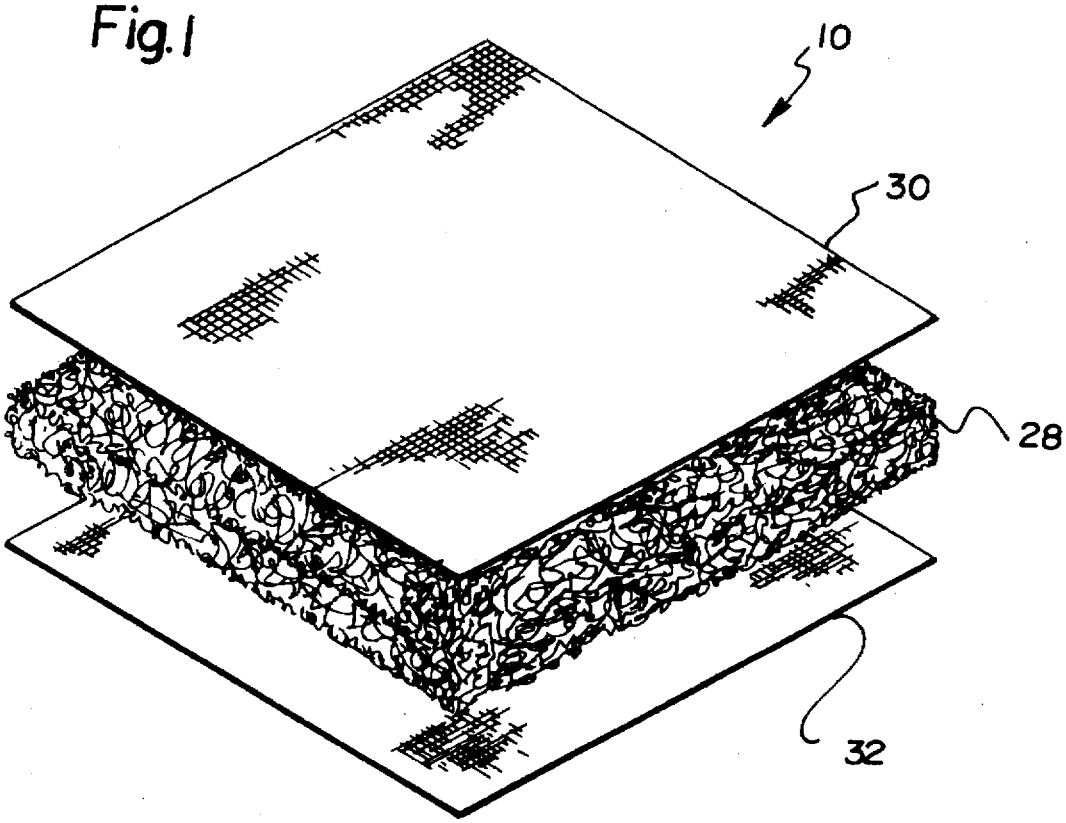
FIG. 1 is a perspective view of the preferred embodiment of the mohair quilted garment insert and method of fabrication constructed in accordance with the principles of the present invention.
Figure 2:
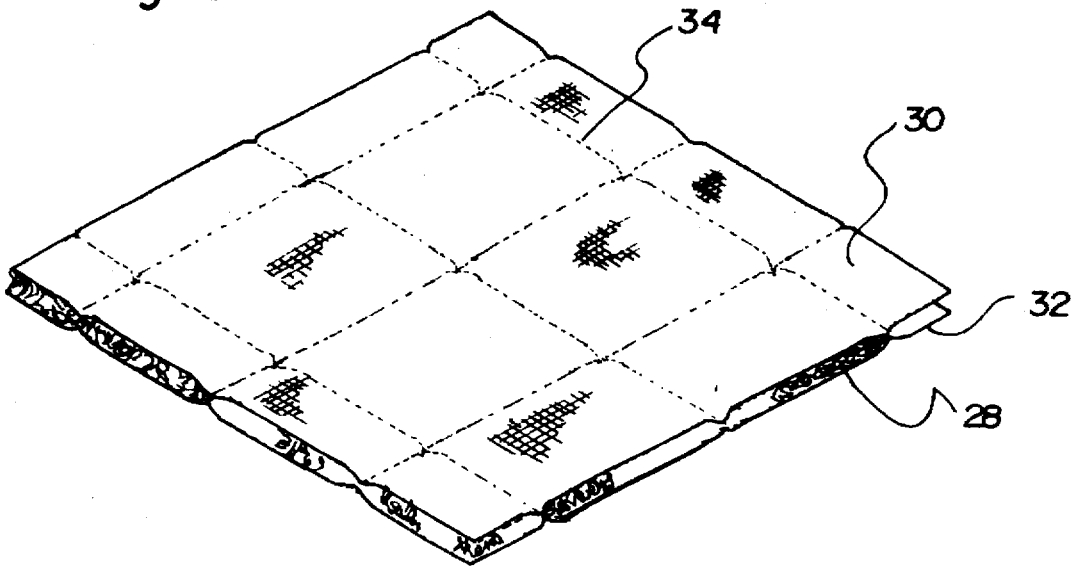
FIG. 2 is a perspective view of the present invention shown quilted together.
Figure 3:
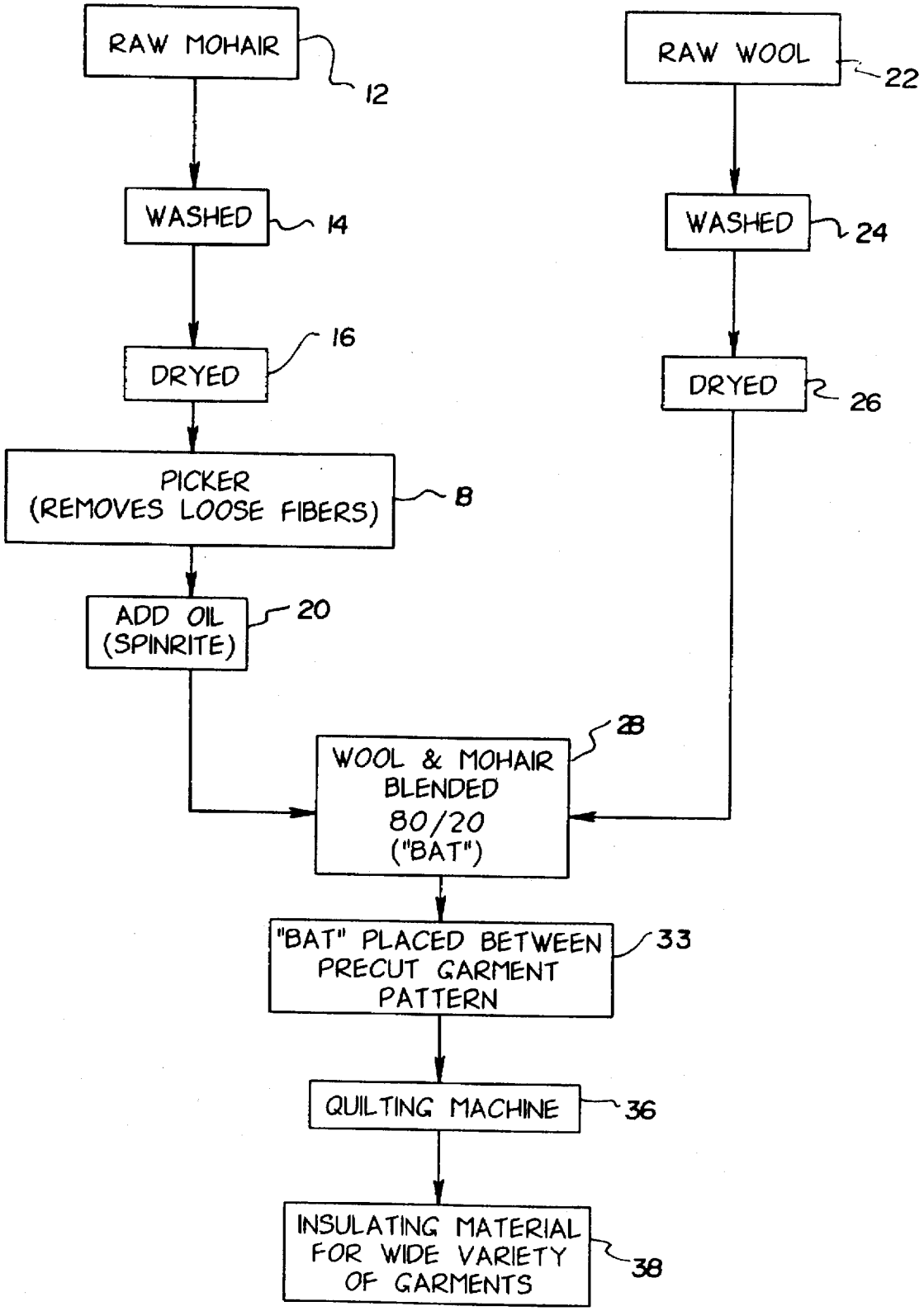
FIG. 3 is a flow chart illustrating the method of arriving at the insert material.

With reference now to the drawings, and in particular, to FIGS. 1–3 thereof, the preferred embodiment of the new and improved mohair quilted garment insert and method of fabrication embodying the principles and concepts of the present invention and generally designated by the reference number 10 will be described.

Specifically, it will be noted in the various Figures that the device relates to a new and improved mohair quilted garment insert and method of fabrication for providing an insert having greater durability characteristics. In its broadest context, the device consists of mohair and wool. Such components are individually configured and correlated with respect to each other so as to attain the desired objective.

The invention is a method of fabricating a quilted garment insert comprising the steps of providing a quantity of raw mohair 12, washing the raw mohair 14, drying the washed mohair 16, picking the dried mohair to remove loose fibers 18, adding a spinrite oil to the picked mohair 20, providing raw wool 22, washing the raw wool 24, drying the washed wool 26, blending the oiled mohair and dried wool to form a bat having about eighty parts by weight of mohair and twenty parts by weight wool 28. Additionally, an outer layer of moisture resistant fabric 30 is provided selected from a class of moisture resistant fabrics including 200 Dermoflex-Registered Trademark or Goretex-Registered Trademark and an inner layer of flexible fabrics 32 is provided selected from a class of flexible fabrics including polyester and silk. The blended wool and mohair 26 is positioned between the outer 30 and inner layers 32 to form a bat between the inner 30 and outer layers 32 to form a precut garment pattern 33. The next step is stitching 34 the precut pattern with a quilting machine 36 to form rectangular pockets to thereby form an insulating material 38. The insulating material 38 is then utilized for a wide variety of garments as a liner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A method of fabricating a quilted garment insert comprising the steps of:

providing a quantity of raw mohair;

washing the raw mohair;

drying the washed mohair;

picking the dried mohair to remove loose fibers;

adding a spinrite oil to the picked mohair;

providing raw wool;

washing the raw wool;

drying the washed wool;

blending the oiled mohair and dried wool to form a bat having about eighty parts by weight of mohair and twenty parts by weight wool;

providing an outer layer of moisture resistant fabric selected from a class of moisture resistant fabrics and providing an inner layer of flexible fabrics selected from a class of flexible fabrics including polyester and silk and positioning the blended wool and mohair between the outer and inner layers to form a bat between the inner and outer layers to form a precut garment pattern;

stitching the precut pattern with a quilting machine to form rectangular pockets to thereby form an insulating material;

utilizing the insulating material for a wide variety of garments as a liner.

2. A method of fabricating a quilted garment insert comprising the steps of:

providing a quantity of raw mohair;

washing the raw mohair;

drying the washed mohair;

picking the dried mohair to remove loose fibers;

adding an oil to the picked mohair;

providing raw wool;

washing the raw wool;

drying the washed wool;

blending the oiled mohair and dried wool to form a bat;

providing an outer layer of moisture resistant fabric and providing an inner layer of flexible fabrics and positioning the blended wool and mohair between the outer and inner layers to form a bat between the inner and outer layers to form a precut garment pattern;

stitching the precut pattern with a quilting machine to form rectangular pockets to thereby form an insulating material;

utilizing the insulating material for a wide variety of garments as a liner.

3. The method as set forth in claim 2 wherein the oil used is selected from a class of oils including spinrite.

4. The method as set forth in claim 2 wherein the inner layer of flexible fabrics selected from a class of flexible fabrics including polyester and silk.

5. The method as set forth in claim 2 wherein the bat having about eighty parts by weight of mohair and twenty parts by weight wool.

* * * * *